US007578085B1

(12) United States Patent
Chao et al.

(10) Patent No.: US 7,578,085 B1
(45) Date of Patent: Aug. 25, 2009

(54) SOLAR POWERED ADDRESS INDICATOR WITH RECHARGEABLE AND REPLACEABLE BATTERIES

(76) Inventors: Albert Chao, 22 Glenwood Dr., Saddle River, NJ (US) 07458; Ethel Chao, 22 Glenwood Dr., Saddle River, NJ (US) 07458

( * ) Notice: Subject to any disclaimer, the term of this patent is extended or adjusted under 35 U.S.C. 154(b) by 96 days.

(21) Appl. No.: 12/024,520

(22) Filed: Feb. 1, 2008

(51) Int. Cl.
*G09F 13/04* (2006.01)
*F21L 4/08* (2006.01)

(52) U.S. Cl. ..... 40/564; 40/576; 362/183; 362/812; 232/17

(58) Field of Classification Search ..... 362/362, 362/183, 812; 40/564, 576; 232/17, 38
See application file for complete search history.

(56) References Cited

U.S. PATENT DOCUMENTS 3,864,861 A * 2/1975 Hill, Jr. ..... 40/576
4,843,525 A 6/1989 Williams
5,143,285 A 9/1992 Wise
5,435,087 A 7/1995 Karkar et al.
5,460,325 A 10/1995 Surman et al.
5,522,540 A 6/1996 Surman
6,299,325 B1 * 10/2001 Cathel ..... 362/183
6,401,373 B1 6/2002 Sexton
6,568,109 B2 * 5/2003 Sanders ..... 40/447
6,719,193 B2 4/2004 Katulka et al.
6,964,366 B2 * 11/2005 Peng et al. ..... 232/38
2003/0121191 A1 * 7/2003 DeJarnette et al. ..... 40/576
2008/0005943 A1 * 1/2008 Chao et al. ..... 40/544

* cited by examiner

*Primary Examiner*—Ali Alavi
(74) *Attorney, Agent, or Firm*—Notaro & Michalos P.C.

(57) ABSTRACT

An address indicator has panels each displaying a translucent character surrounded by an opaque area. A frame with a channel slidably captures the panels and has an upper chamber above the channel and a rear chamber behind the channel. Stops at opposite ends of the channel keep the panels in the channel and lights such as LEDs are spaced in the upper chamber for casting light into the rear chamber. A translucent screen in the rear chamber defuses light for illuminating the translucent character of each panel. Solar cells charge replaceable, rechargeable batteries for powering the lights.

20 Claims, 2 Drawing Sheets

60
62
64
66
71
84
70
82
68
42
32
72
18
46
16
44
14
34
20
40
52
88
86
80
22
26
56
58
82
50
36
44
38
37
52
28
90
18
24
30
12
16
14

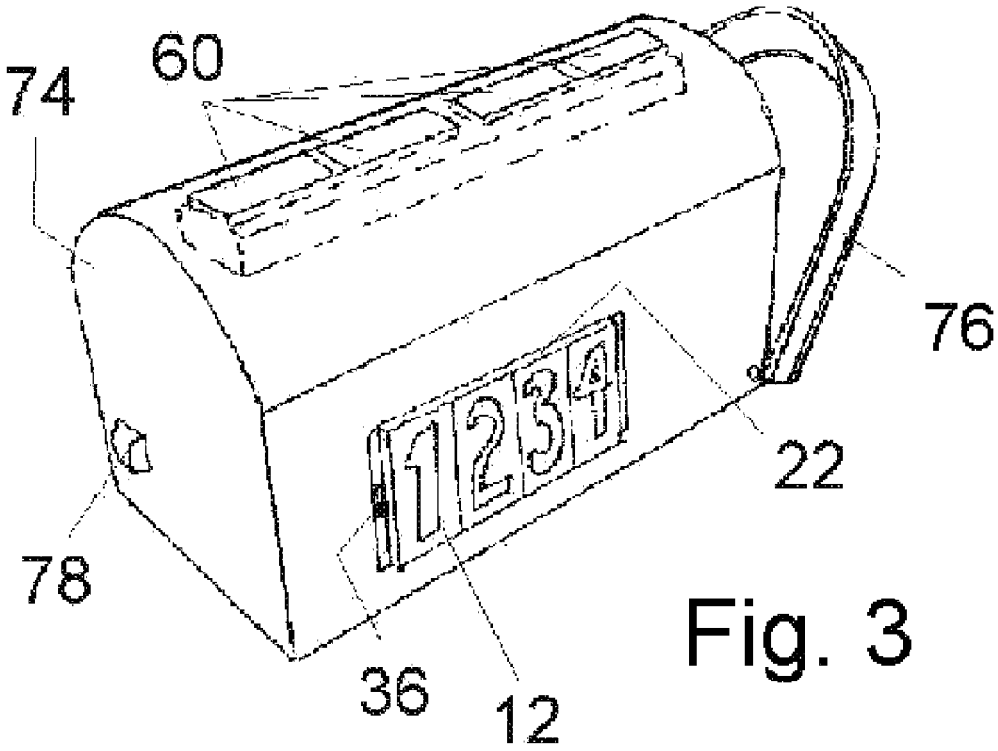
Fig. 3
Fig. 4
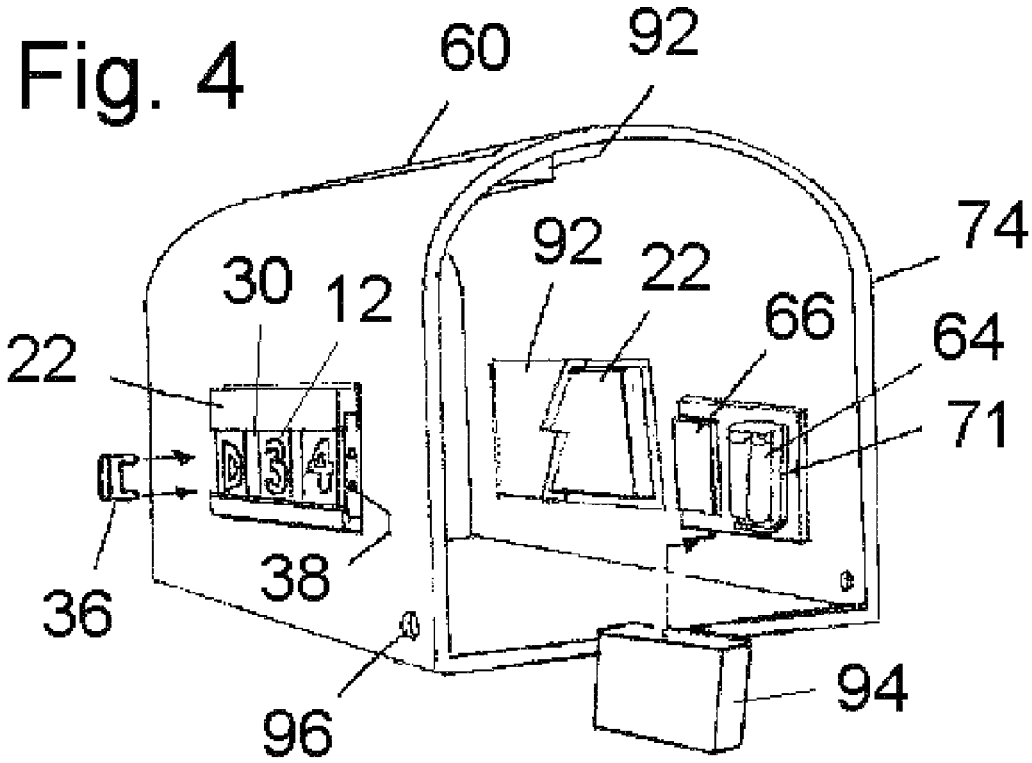

SOLAR POWERED ADDRESS INDICATOR WITH RECHARGEABLE AND REPLACEABLE BATTERIES

FIELD AND BACKGROUND OF THE INVENTION

The present invention relates generally to the field of address indicators and mailboxes, and in particular, to a new and useful address indicator combination that is solar powered and is for use with and without a mailbox, for displaying the address of a house or building or the like.

Illuminated signs for indicating the address number for a house or building, where the illumination energy is solar powered, are well known. U.S. Pat. No. 4,843,525 to Williams, discloses a solar powered yard marker having individual character panels. Also see U.S. Pat. No. 5,435,087 to Karkar et al.

An Illuminated sign in conjunction with a mailbox is known from U.S. Pat. No. 5,143,285 to Wise. A combination mailbox and address indicator which is solar powered, is also know from U.S. Pat. No. 5,460,325 to Surman. Also see U.S. Pat. No. 5,522,540 to Surman for a mailbox with address indicator and separately mounted solar panel. Another example is U.S. Pat. No. 6,299,325 to Cathel and another illuminated display with separately mountable characters that are back lit, is disclosed by U.S. Pat. No. 6,401,373 to Sexton.

An address indicator with mailbox, solar powering and a rail system for a slidably receiving multiple character panels is disclosed by U.S. Pat. No. 6,708,876 to Shirah. Also see U.S. Pat. No. 6,719,193 to Katulka and U.S. Pat. No. 6,964,366 to Peng, et al.

Finally for the inventors' previous patent application which is not prior art to the present application, but which shows additional thinking on the part of the inventors, see U.S. Published Patent Application 2008/0005943 published Jan. 10, 2008 to Chao, et al.

A need remains for a practical, economical, easy to use and long lasting, solar powered address indicator.

SUMMARY OF THE INVENTION

It is an object of the present invention to provide an address indicator combination comprising: a plurality of rectangular character panels each displaying a translucent character that is surrounded by an opaque remainder of each panel; a frame defining a channel with upper and lower rails spaced by an amount for capturing the height of each character panels that are each slidably engaged between the rails, the channel having a length equal to at least an integral number of panel widths, the frame including an upper chamber above the channel and a rear chamber behind the channel defining a space; and stop means for stopping the character panels that are between the rails, from sliding out of the channel.

A further object of the invention is to provide an address indicator combination which includes a plurality of electrically powered light sources spaced from each other in the upper chamber for casting light into the space; a translucent screen in the space for defusing the light from the space into the channel for illuminating the translucent character of each panel captured by the rails, the translucent screen including an upper edge with a lens adjacent each light for helping to defuse the light.

Another object of the invention is to provide an address indicator combination that includes a plurality of solar cells for receiving light and for converting the light into electrical energy; a battery compartment for receiving a plurality of replaceable and rechargeable batteries; and a power distribution circuit connected to the solar cells for receiving electrical power from the solar cells and being connected to the battery compartment for supplying the electrical power to charge batteries in the compartment when electrical power is being converted from light by the solar cells, the circuit being connected to the light source for supplying power from charged batteries in the compartment to the light source to light the light source when no electrical power is being converted from light by the solar cells.

A still further object of the invention is to provide an address indicator combination including a mailbox defining an enclosure for receiving mail, the mailbox having a side wall for receiving the frame for displaying the characters, a top wall for receiving the solar cells and for exposing the solar cells upwardly for receiving sun light, and an on-off switch connected to the circuit and mounted to the mailbox for manually interrupting power supply to the light source so that any charge of batteries in the compartment is maintained.

A further object of the invention is to provide an address indicator combination that includes a door that is manually openable for exchanging rechargeable batteries in the compartment.

A further object of the invention is to provide an address indicator combination wherein the plurality of solar cells, the battery compartment and the power distribution circuit are mounted in a housing that is separate from the frame, the frame and the housing each having a positive and negative electrical and mechanical connector that are each mechanically and electrically connectable to each other in only one way so that polarity of the connection between the frame and housing is always the same, the electrical and mechanical connectors of the housing being connected to the circuit and the electrical and mechanical connectors of the frame being connected to the light source.

A still further object of the invention is to provide an address indicator, with or without mailbox, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a perspective view of a second embodiment of the invention with a mailbox; and FIG. 4 is a perspective view of a third embodiment of the invention with a mailbox.

DESCRIPTION OF THE PREFERRED EMBODIMENTS

Figures 1, 2:
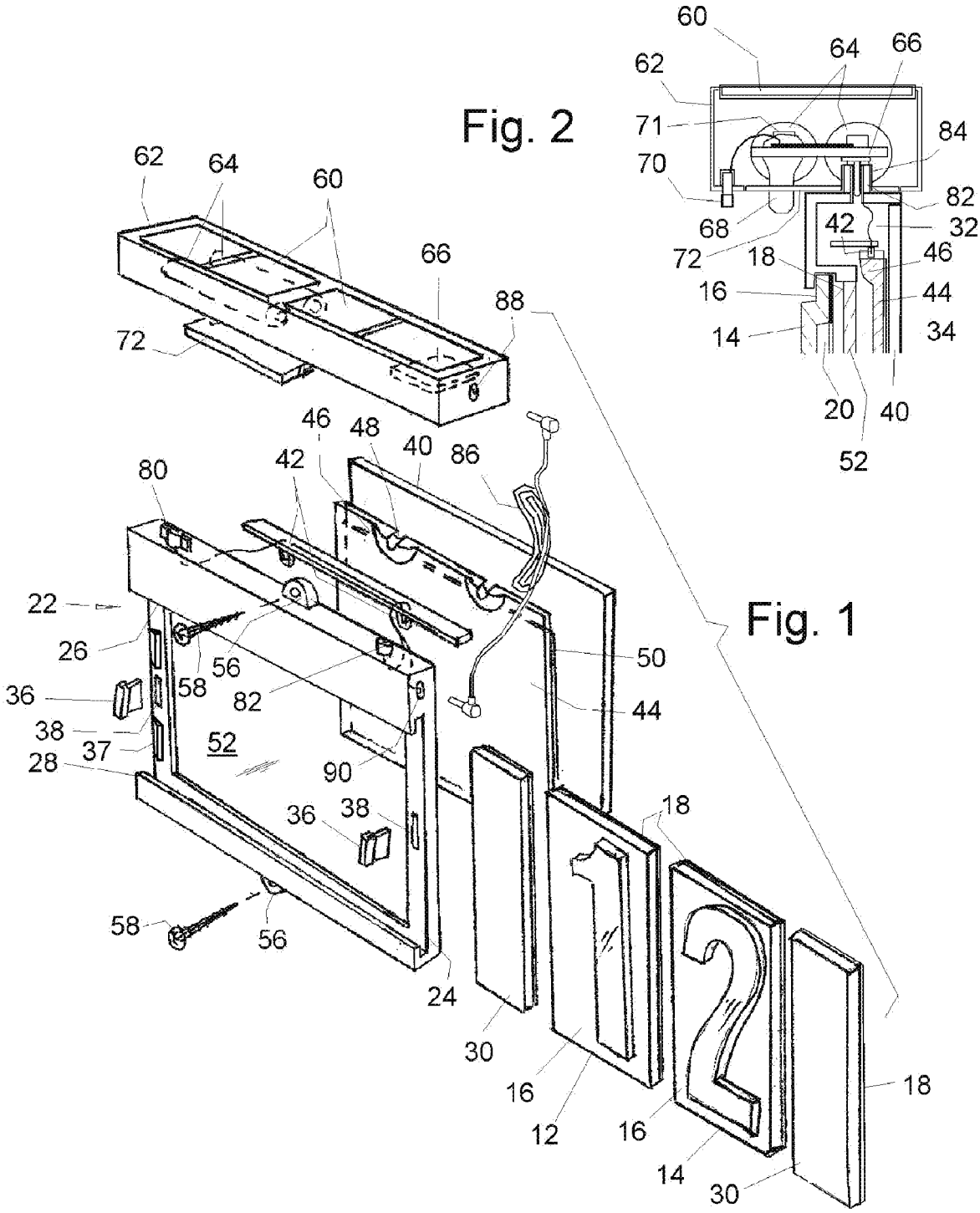
FIG. 1 is an exploded perspective view of one embodiment of the address indicator combination of the invention.
FIG. 2 is a partial, sectional view of the first embodiment.

Referring now to the drawings, in which like reference numerals are used to refer to the same or functionally similar elements, FIG. 1 illustrates an address indicator combination comprising a plurality of rectangular character panels 12 and 14 each displaying a translucent character such as a number, e.g. the number "1" on panel 12, or a letter or symbol. The panels are each made of clear, colorless plastic, such as acrylic, polystyrene, or other suitable plastic known to those skilled in the art to be weather resistant, and each character is surrounded by an opaque, e.g. black, remainder or surrounding area 16 on each panel.

The character on each panel is thus made to be translucent, which is meant here to include, but not be limited to, transparent. Since the volume of each panel is made of clear plastic material, this is achieved by screen printing, painting or otherwise applying a layer 18 of black or other opaque material onto the rear surface of each panel, everywhere except the rear area of the character in that panel. Each panel is also cast or otherwise formed so that the shape of the character projects forwardly of the front surface of the remainder of the panel at 16, and the rear surface of each panel is indented or recessed at 20 in FIG. 2, so that the opaque area defined by layer 18 surrounds the translucent character for each panel.

Each panel 12 and 14, also has a height and a width, and the combination includes a frame 22 defining a channel 24 with upper and lower rails 26, 28, spaced by slightly more than the panel height, thus by an amount for capturing the height of each of a plurality of the character panels 12 and 14, that are each slidably engaged between the rails. The channel 24 has a length equal to at least an integral number of panel widths, so that an integral number of panels, e.g. three panels in the example illustrated in FIG. 1 or four in the embodiment of FIG. 4, can fit in the channel 24. In case the address to be displayed has one less character than the frame can hold, the extra space is filled either by a panel that is the same height and width as the character panel but which is entirely opaque, or, in order to center the character panels, a pair of half panels 30 are provided which are slide into the channel 24 on opposite sides of the one, two, or more character panels. Each half panel 30 is made of the same material as the character panels 12 and 14, for example, and has a rear surface that is entirely covered by the opaque layer 18.

The frame also includes an upper chamber 32 above the channel 24 as shown in FIG. 2, and a rear chamber 34 behind the channel and defining a space there as also shown in FIG. 2.

As shown in FIGS. 1 and 3, stop means for stopping sliding of character panels that are between the rails, from sliding out of the channel 24, are provided, for example, in the form of pins, pegs or tabs 36 that are inserted into close fitting apertures 38 at the opposite ends of the channel. Alternatively, two or more pegs (which term is used to identify any of a cylindrical, oval, square, rectangular or other shaped pin, peg or tab) are provide on one or both ends, or one end of the channel is closed by a wall (not shown) or by stops of one-way ramps 37 that allow the panels to slide only into the channel 24, and only the opposite end is provided with one or more pegs. In a still further alternative for the stop means, a rear closure panel 40, to be discussed in greater detail later in this disclosure, has opposite vertically and forwardly extending side flanges (not shown) that engage over opposite sides of the channel 24 and thus lock the panels in the channel. In any case the distance between the stop means is equal to an integral number of panel widths so that the panels 30, 12, 14 and 30 in FIG. 1, are held securely in the channel 24 without room to slide back and forth.

A plurality of electrically powered light sources, such as LEDs 42, are spaced along and are disposed in the upper chamber 32 for casting light into the space of the rear chamber 34. In the embodiment of FIGS. 1 and 2, two LEDs 42 are spaced along the chamber 32 by being mounted on a circuit board that, in turn, is fixed in the upper chamber 32. The two LEDs thus illuminate the two or three characters of the address to be indicated. In the embodiment of FIG. 3, three evenly spaced LEDs are use for illuminating the four characters. In general, there are fewer light sources than spaces for characters since the light is effectively disbursed by the invention as will be explained below, and fewer light sources consume less energy and thus stay lit longer when being powered by stored solar energy as is the case here.

As shown in FIGS. 1 and 2, a translucent screen 44 extends in the space of the rear chamber 34, behind the channel 24, and defuses the light from the space into the channel for illuminating the translucent characters of the panels captured in the rails 26 and 28. The translucent screen is also advantageously made of clear, colorless plastic, such as acrylic, polystyrene, or other suitable plastic known to those skilled in the art, and includes an upper edge with a half lens 46 adjacent each light 42 for helping to defuse the light. Each lens 46 has one surface, e.g. the rear surface, that is flat and co-planar with the rest of the rear surface of the screen 44, and an opposite e.g. front surface that is convex to refract light from an LED that sits in a semi-cylindrical recess 48 at the top center of each lens, out into the body of the screen and into the channel 24 to illuminate the translucent characters of panels 12 and 14.

To further diffuse the light and prevent hot spots of greater illumination immediately adjacent the LEDs 42, a white clouded sheet of translucent film 50 is applied to the front or rear surface of the screen 44 and to better weather proof the invention, a clear plastic weather panel 52 is sealing in the frame 22, between the channel 24 and the rear chamber 34. Weather panel 52 can also be made of colorless plastic, such as acrylic, polystyrene, or other suitable plastic known to those skilled in the art. Also to better reflect all of the light to the front, the closure panel 40 is preferable made of white plastic material such as white acrylic, polystyrene, or other suitable plastic known to those skilled in the art.

In order to mount the frame to a surface, such as the surface of a house, address post or office building, frame 22 has one or more upper and lower ears 56 with holes for receiving fasteners such as screws 58.

The invention also includes a plurality of solar cells 60 for receiving light and for converting the light into electrical energy, and a battery compartment with a battery cradle 71 in a housing or compartment 62 for receiving a plurality of rechargeable and exchangeable batteries 64, e.g. AA, Nickel Cadmium, NiMH or Nickel Metal Halide or Lithium Ion or other rechargeable batteries now existing or to be discovered. Since the address indicator of the invention is meant for long service and most rechargeable batteries can only last for about 500 to 1000 charge cycles, the use of replaceable, rechargeable batteries greatly extends the useful life of the invention.

A power distribution circuit on a circuit board 66 in compartment 62, is connected to the solar cells 60 for receiving electrical power from the solar cells and is connected to the battery cradle in the compartment for supplying the electrical power to charge the batteries 64 in the compartment when electrical power is being converted from light by the solar cells. The circuit is connected to the light sources 42 for supplying power from charged batteries 64 in the compartment to the light sources to light the light sources when no electrical power is being converted from light by the solar cells. To further extend the life of the batteries, the batteries are electrically isolated from one of their contacts in their cradle by an insulating, flexible plastic tab 68 in FIG. 2, that has a portion that extends out through a slot between a manually openable battery door 72 over the battery cradle, and the surrounding compartment. When the address indicator of the invention is ready for use, the tab 68 is pulled out to allow electrical contact with the batteries. In addition to, or instead of tab 68, the invention includes a circuit breaker 70 that opens the circuit on board 66 until the address indicator is ready of use, and can be pulled out to close the circuit to allow the unit to operate.

As shown in FIG. 3, in one embodiment of the invention, the address indication combination includes a mailbox 74 defining an enclosure for receiving mail through an openable and closeable mail door 76. The mailbox has a side wall with a rectangular opening for receiving the frame 22 that is fixed, e.g. by sonic welding, glueing or screws, to the mail box, and for displaying the characters of panels 12 and others, at the side of the mailbox. The mailbox 74 also has a top wall with a rectangular opening for receiving and fixing the solar cells 60 and for exposing the solar cells upwardly for receiving sun light. The mailbox embodiment also has a manual on-off switch 78 connected to the circuit in the mailbox and mounted to the mailbox for manually interrupting power supply to the light source so that any charge on the batteries in the compartment is maintained during storage and shipping and before use, and when the owner of the address indicator with mailbox wishes to deactivate illumination of the characters.

The same type of compartment 62 as in FIG. 1 is fixed under the top wall of mailbox 74 and is electrically connected to the LEDs in FIG. 3, so that the batteries can be changed by opening mail door 76, then opening battery door 72 inside the mailbox. Alternatively the battery compartment is mounted on one of the inside side walls of the mailbox 74 and has a battery door that is opened to replace the batteries when needed.

Functionally the light sources and solar cell arrangement of FIG. 1 is mounted in the mailbox of FIG. 3. In the embodiment of FIGS. 1 and 2, however, the plurality of solar cells, the battery compartment and the power distribution circuit are mounted in a housing, namely the compartment 62, that is separate from the frame 24. The frame and the housing each having a positive and a negative electrical and mechanical connector in the from of male keyed post 80 with wings, and a round male post 82, that mate with correspondingly shaped female keyed and female round receptacles 84 in the housing for mechanically and electrically connecting to each other in only one way so that polarity of the connection between the frame and housing is always the same, the electrical and mechanical connectors of the housing being electrically connected to the circuit, and the electrical and mechanical connectors of the frame being electrically connected to the light sources.

If the frame 24 must be mounted at a distance from the housing 62, a connecting wire 86 is used that has end plugs that plug into sockets 88 and 90 on the respective housing and frame, connected to the respective solar circuit 66 and LEDs 42, so the frame and housing can be mounted at different locations.

FIG. 4 illustrates a further embodiment of the invention where the mailbox 74 is made of molded ABS plastic or die case aluminum and has a top wall with a formed pocket 92 that receives the solar cell arrays 60, and a side wall also with a formed pocket 92 shown with the front part of the pocket cut away so that the frame 22 that is glued or otherwise fixed in the pocket, can be seen.

A peg 36 in this embodiment has a rectangular handle with two cylindrical posts extending from the handle for being force fit into a pair of apertures 38 at the front end of the channel for the character panels 12 and half width spacer panels 30. In this case the three charter panels (that carry the characters "D" and "3" and "4") have the spacers 30 between the characters for a neat even display.

A battery cradle 71 with replaceable, rechargeable batteries 64, is mounted on a support on the inside surface of the side wall for each of the frames 22 (one for each side wall in the embodiment of FIG. 4) near one frame, and the circuit board 66 is mounted next to the battery cradle on the same support. A removable cover box 94 is snap-fit over the support for the cradle and circuit, to cover both during use of the mailbox.

Holes 96 are provided for mounting the hinges for the mailbox door shown, e.g. at 76 in FIG. 3, and a door can be provided at one end or at both ends of the mailbox.

Throughout this specification and the claims, relative terms such as upper, lower, inner, outer, left, right, front, rear, in front of, behind, and the like, are used for a better understanding of the orientation and structure of the parts of the preferred embodiments of the invention, and are meant to include their opposite meaning when determining the meaning and scope of protection afforded by the claims.

While specific embodiments of the invention have been shown and described in detail to illustrate the application of the principles of the invention, it will be understood that the invention may be embodied otherwise without departing from such principles.

What is claimed is:

1. An address indicator combination comprising:

a plurality of rectangular character panels each having a translucent character that is surrounded by an opaque remainder of each panel, and each having a height and a width;

a frame defining a channel with upper and lower rails spaced by an amount for capturing the height of each of a plurality of said character panels that are each slidably engaged between the rails, the channel having a length equal to at least an integral number of panel widths, the frame including an upper chamber above the channel and a rear chamber behind the channel defining a space;

stop means for stopping character panels that are between the rails, from sliding out of the channel;

a plurality of electrically powered light sources spaced along and being within the upper chamber for casting light into the space;

a translucent screen in the space for defusing light from the space into the channel for illuminating the translucent character of each panel captured between the rails, the translucent screen including an upper edge with a lens adjacent each light for helping to defuse the light;

a plurality of solar cells for receiving light and for converting the light into electrical energy;

a battery compartment with a battery cradle for receiving a plurality of rechargeable and replaceable batteries; and a power distribution circuit connected to the solar cells for receiving electrical power from the solar cells and being connected to the battery compartment for supplying the electrical power to charge batteries in the compartment when electrical power is being converted from light by the solar cells, the circuit being connected to the light sources for supplying power from charged batteries in the compartment to the light sources to light the light sources when no electrical power is being converted from light by the solar cells.

2. The combination of claim 1, including a mailbox defining an enclosure for receiving mail, the mailbox having a side wall for receiving the frame for displaying the characters, a top wall for receiving the solar cells and for exposing the solar cells upwardly for receiving sun light, and an on-off switch connected to the circuit and mounted to the mailbox for manually interrupting power supply to the light sources so that any charge of batteries in the compartment is maintained.

3. The combination of claim 1, including a mailbox defining an enclosure for receiving mail, the mailbox having a side wall with a pocket formed in the side wall, for receiving the frame for displaying the characters, a top wall for receiving the solar cells and for exposing the solar cells upwardly for receiving sun light, the compartment being mounted in the mailbox and having a door for covering the battery cradle and that is manually removable for exchanging rechargeable batteries in the compartment.

4. The combination of claim 1, wherein the plurality of solar cells, the battery compartment and the power distribution circuit are mounted in a housing that is separate from the frame, the frame and the housing each having a positive and negative electrical and mechanical connector that are each mechanically and electrically connected to each other in only one way so that polarity of the connection between the frame and housing is always the same, the electrical and mechanical connectors of the housing being connected to the circuit and the electrical and mechanical connectors of the frame being connected to the light sources, the housing having a door for covering the battery cradle and that is manually removable for exchanging rechargeable batteries in the compartment, there being fewer light sources than spaces in the channel for character panels.

5. The combination of claim 1, wherein the frame includes the plurality of the light sources which are each an LED spaced along the upper chamber above the space for distributing light evenly along the screen, there being fewer LEDs than spaces in the channel for character panels, the combination including a mailbox defining an enclosure for receiving mail, the mailbox having a side wall for receiving the frame for displaying the characters, a top wall for receiving the solar cells and for exposing the solar cells upwardly for receiving sun light, and an on-off switch connected to the circuit and mounted to the mailbox for manually interrupting power supply to the LEDs so that any charge of batteries in the compartment is maintained, the compartment being mounted in the mailbox and having a door that is manually openable for exchanging rechargeable batteries in the compartment.

6. The combination of claim 1, wherein the frame includes a plurality of the light sources which are each an LED spaced along the upper chamber above the space for distributing light evenly along the screen, the plurality of solar cells, the battery compartment and the power distribution circuit being mounted in a housing that is separate from the frame, the frame and the housing each having a positive and negative electrical and mechanical connector that are each mechanically and electrically connected to each other in only one way so that polarity of the connection between the frame and the housing is always the same, the electrical and mechanical connectors of the housing being connected to the circuit and the electrical and mechanical connectors of the frame being connected to the LEDs.

7. The combination of claim 1, including a closure plate connected to the frame for closing a rear of the rear chamber, the frame including a plurality of the light sources which are each an LED spaced along the upper chamber above the space for distributing light evenly along the screen, the plurality of solar cells, the battery compartment and the power distribution circuit being mounted in a housing that is separate from the frame, the frame and the housing each having a positive and negative electrical and mechanical connector that are each mechanically and electrically connected to each other in only one way so that polarity of the connection between the frame and the housing is always the same, the electrical and mechanical connectors of the housing being connected to the circuit and the electrical and mechanical connectors of the frame being connected to the LEDs.

8. The combination of claim 1, including a pair of half panels that are each opaque and each have the same height as one of the character panels and one half the width of one of the character panels for being slide on opposite sides of at least one character panel in the channel for substantially filling the channel.

9. The combination of claim 1, wherein the stop means comprise at least one peg inserted into a close fitting aperture at least one end of the channel.

10. The combination of claim 1, including a clouded translucent film on one of a rear and front surface of the translucent screen.

11. The combination of claim 1, wherein the light sources are each an LED, the translucent screen including a recess for each LED in the upper edge and each centered on one said lens, each lens being substantially semi-circular.

12. The combination of claim 1, wherein each character panel has a volume of clear plastic material, and has a rear surface covered by a layer of opaque material everywhere except a rear area of the character on the panel.

13. The combination of claim 1, wherein each character panel has a volume of clear plastic material, and has a rear surface covered by a layer of opaque material everywhere except a rear area of the character on the panel, each panel being formed so that the shape of the character projects forwardly of a front surface of the remainder of the panel and the rear surface of each panel is indented so that a opaque area defined by the layer surrounds the translucent character for each panel.

14. The combination of claim 1, including a white closure plate connected to the frame for closing a rear of the rear chamber and for reflecting light toward the channel, the frame including a plurality of the light sources which are each an LED spaced along the upper chamber above the space for distributing light evenly along the screen, the plurality of solar cells, the battery compartment and the power distribution circuit being mounted in a housing that is separate from the frame, the frame and the housing each having a positive and negative electrical and mechanical connector that are each mechanically and electrically connected to each other in only one way so that polarity of the connection between the frame and the housing is always the same, the electrical and mechanical connectors of the housing being connected to the circuit and the electrical and mechanical connectors of the frame being connected to the LEDs.

15. An address indicator combination comprising:

a plurality of rectangular character panels each having a translucent character that is surrounded by an opaque remainder of each panel, and each having a height and a width;

a frame defining a channel with upper and lower rails spaced by an amount for capturing the height of each of a plurality of said character panels that are each slidably engaged between the rails, the channel having a length equal to at least an integral number of panel widths, the frame including an upper chamber above the channel and a rear chamber behind the channel defining a space;

stop means for stopping sliding of character panels that are between the rails, out of the channel;

a plurality of electrically powered light sources spaced along and being in the upper chamber for casting light into the space;

a translucent screen in the space for defusing light from the space into the channel for illuminating the translucent character of each panel captured by the rails, the translucent screen including an upper edge with a lens adjacent each light source for further defusing the light;

a plurality of solar cells for receiving light and for converting light into electrical energy;

a battery compartment with a cradle for receiving a plurality of rechargeable and replaceable batteries;

a power distribution circuit connected to the solar cells for receiving electrical power from the solar cells and being connected to the battery compartment for supplying the electrical power to charge batteries in the cradle when electrical power is being converted from light by the solar cells, the circuit being connected to the light sources for supplying power from charged batteries in the compartment to the light source to light the light source when no electrical power is being converted from light by the solar cells; and a mailbox defining an enclosure for receiving mail, the mailbox having a side wall for receiving the frame for displaying the characters, a top wall for receiving the solar cells and for exposing the solar cells upwardly for receiving sun light, and an on-off switch connected to the circuit and mounted to the mailbox for manually interrupting power supply to the light source so that any charge of batteries in the compartment is maintained, the compartment being mounted in the mailbox and having a battery door that is manually openable for exchanging rechargeable batteries in the compartment.

16. The combination of claim 15, including a pair of half panels that are each opaque and each have the same height as one of the character panels and one half the width of one of the character panels for being slide on opposite sides of at least one character panel in the channel for substantially filling the channel.

17. The combination of claim 15, wherein the stop means comprise at least one peg inserted into a close fitting aperture at least one end of the channel.

18. An address indicator combination comprising:

a plurality of rectangular character panels each having a translucent character that is surrounded by an opaque remainder of each panel, and each having a height and a width;

a frame defining a channel with upper and lower rails spaced by an amount for capturing the height of each of a plurality of said character panels that are each slidably engaged between the rails, the channel having a length equal to at least an integral number of panel widths, the frame including an upper chamber above the channel and a rear chamber behind the channel defining a space;

stop means for stopping character panels that are between the rails, from sliding out of the channel;

a plurality of electrically powered light sources spaced along and being in the upper chamber for casting light into the space;

a translucent screen in the space for defusing light from the space into the channel for illuminating the translucent character of each panel captured between the rails, the translucent screen including an upper edge with a lens adjacent each light source for further defusing the light;

a plurality of solar cells for receiving light and for converting light into electrical energy;

a battery compartment with a cradle for receiving a plurality of rechargeable and replaceable batteries; and a power distribution circuit connected to the solar cells for receiving electrical power from the solar cells and being connected to the battery compartment for supplying the electrical power to charge batteries in the cradle when electrical power is being converted from light by the solar cells, the circuit being connected to the light sources for supplying power from charged batteries in the cradle to the light sources to light the light sources when no electrical power is not being converted from light by the solar cells;

the plurality of solar cells, the battery compartment and the power distribution circuit being mounted in a housing that is separate from the frame, the frame and the housing each having a positive and negative electrical and mechanical connector that are each mechanically and electrically connected to each other in only one way so that polarity of the connection between the frame and the housing is always the same, the electrical and mechanical connectors of the housing being connected to the circuit and the electrical and mechanical connectors of the frame being connected to the light sources.

19. The combination of claim 18, including a white closure plate connected to the frame for closing a rear of the rear chamber and for reflecting light toward the channel, the frame including a plurality of the light sources which are each an LED spaced along the upper chamber above the space for distributing light evenly along the screen, the plurality of solar cells, the battery compartment and the power distribution circuit being mounted in a housing that is separate from the frame, the frame and the housing each having a positive and negative electrical and mechanical connector that are each mechanically and electrically connected to each other in only one way so that polarity of the connection between the frame and the housing is always the same, the electrical and mechanical connectors of the housing being connected to the circuit and the electrical and mechanical connectors of the frame being connected to the LEDs.

20. The combination of claim 18, wherein the stop means comprise at least one peg inserted into a close fitting aperture at least one end of the channel.

* * * * *